United States Patent [19]

Kreitzberg

[11] 4,364,519

[45] Dec. 21, 1982

[54] NOZZLE ASSEMBLY FOR LOW PRESSURE IMPACT SPRINKLER

[75] Inventor: Jeffrey P. Kreitzberg, Walla Walla, Wash.

[73] Assignee: Nelson Irrigation Corporation, Walla Walla, Wash.

[21] Appl. No.: 283,193

[22] Filed: Jul. 14, 1981

[51] Int. Cl.[3] ..... B05B 3/16

[52] U.S. Cl. ..... 239/230; 239/233; 239/599; 239/600; 239/601

[58] Field of Search ..... 239/230, 233, 590.3, 239/591, 599, 600, 601

[56] References Cited

U.S. PATENT DOCUMENTS

| | | | |
|---|---|---|---|
| 4,091,996 | 5/1978 | Nelson | 239/230 |
| 4,139,022 | 2/1979 | Marmon, Jr. | 239/590.3 |
| 4,195,782 | 4/1980 | Troup | 239/230 |
| 4,205,787 | 6/1980 | Bruninga | 239/230 |

*Primary Examiner*—John J. Love
*Assistant Examiner*—Michael J. Forman
*Attorney, Agent, or Firm*—Cushman, Darby & Cushman

[57] ABSTRACT

A nozzle assembly for a water sprinkler such as a rotary impact head comprising a generally flat member of wear resistant thermoset elastomeric material having an aperture in the central portion thereof constituting the stream defining orifice of the nozzle and a housing member mounting the elastomeric member and a backing member therefor in a sprinkler in flow transmitting relation to a source of water under pressure communicated therewith. The backing member has a central opening through which the stream defined by the nozzle orifice passes and a surface surrounding the opening facing in a direction opposed to the direction of stream movement operable to engage and support the elastomeric member in a deformed operative condition in which first portions of the flat member defining diametrically opposed portions of the periphery of the aperture thereof are disposed in downstream spaced relation with respect to second portions thereof defining diametrically opposed portions of the periphery of the aperture thereof displaced 90° from the first portions so that the stream as it issues from the aperture of the flat member in the aforesaid deformed condition tends to remain flattened in the direction of the first portions and to fan out in a desirable droplet size in the direction of the second portions.

12 Claims, 10 Drawing Figures

NOZZLE ASSEMBLY FOR LOW PRESSURE IMPACT SPRINKLER

This invention relates to water sprinklers and more particularly to improvements in the nozzle construction embodied in water sprinklers.

The increasing costs of energy and decreasing supply of water have resulted in the desirability of operating sprinkler irrigation systems at lower pressures. Conventional impact sprinkler heads have been used over the years primarily as a high pressure device for distributing a given quantity of water over the greatest possible ground pattern area. The operation of impact sprinkler heads under relatively high pressures is desirable and essential for two reasons. First, a relatively high pressure level is required to cause the impact arm to cycle properly. Second, a relatively high pressure is required to project the water stream through the air in such a way as to be broken up into relatively fine droplets.

When efforts are made to operate a conventional impact sprinkler head at relatively low pressures, as for example 20 psi and the like, it becomes possible to modify the impact arm system so that it will properly cycle under the lower pressure conditions. However, the condition of the stream is such that it does not break up into small droplets but rather falls to the ground with droplets of a size sufficiently large to cause soil damage. Consequently, in order to provide total satisfactory operation at lower pressures it becomes necessary not only to modify the impact forces required to cycle the impact arm but in addition to provide for modification of the water stream sufficient to cause the stream to break up into particles of sufficiently fine size to avoid soil damage.

The manner in which the stream is modified to get stream break-up at low pressure is limited because of the need to maintain stream integrity near the nozzle so as to provide maximum energy to effect input arm cycling and at the same time so modify the stream that it will later break up into fine droplets. One approach has been to divide the nozzle orifice into two orifices so that there issue therefrom two streams which can be directed toward one another to obtain optimum cycling of the input arm and at the same time to cause the same to interact with an action capable of creating small droplets. An example of an arrangement of this type is illustrated in U.S. Pat. No. 4,195,782. While the arrangement achieves a measure of increased small droplet distribution within the stream, the provision of a stream divider within the nozzle has the effect of increasing debris hang-up. Moreover, the size of each orifice must of necessity be less than the size of a comparably sized single orifice, a condition which also can contribute to debris hang-up. Moreover, because the configuration of the nozzle requires abrupt changes in the direction of movement of the water, the positions where abrupt changes take place establish surface areas where severe wear tends to take place. Such wear may be considered inconsequential when sprinklers of this type are used with municipal water piped to residences suitable for drinking. However, when the sprinkler is being utilized in agricultural irrigation applications where the water source may contain sand particles and other debris, such wear can materially alter the output rate of the sprinkler.

It has been found that a favorable small droplet distribution at low pressure can be achieved by the utilization of conventional fan-shaped spray nozzles. However, here again since spray nozzles of this type are not symmetrical but must cause the water flowing therethrough to change direction abruptly, the same tendency to wear where the source of water is of the type encountered in agricultural irrigation results in the serviceable life of such conventional fan-shaped nozzles to be unsatisfactory. One of the problems associated with excessive wear in connection with conventional fan-shaped spray nozzles is that the precise area within the nozzle where wear is most likely to occur is in the area which defines the flatness of the spray. Consequently, an increase in this dimension greatly increases the rate of flow through the nozzle. Such extreme variation in the quantity of flow through a given nozzle orifice cannot be tolerated in agricultural sprinkler irrigation systems.

Accordingly it is an object of the present invention to provide a nozzle construction capable of achieving fan-shaped spray stream pattern with desirable droplet distribution under low pressure conditions which is capable of extended operation under severe agricultural irrigation water source conditions.

In accordance with the principles of the present invention this objective is obtained by providing a flat member of a highly wear resistant thermoset elastomer and deforming the flat member into a shape sufficient to define a fan-shaped spray. With this arrangement it becomes possible to use thermoset materials, such as polyurethane, of the type unsuitable for compression or injection molding which provide wear characteristics greatly in excess of plastic materials capable of being compression or injection molded or metals of the type normally utilized as the material for conventional fan-shaped spray nozzles.

Another object of the present invention is to provide a nozzle construction for sprinklers of the type described which is simple in construction, effective in operation and economical to manufacture.

These and other objects of the present invention will become more apparent during the course of the following detailed description and appended claims.

The invention may best be understood with reference to the accompanying drawings, wherein an illustrative embodiment is shown.

Figure 1:
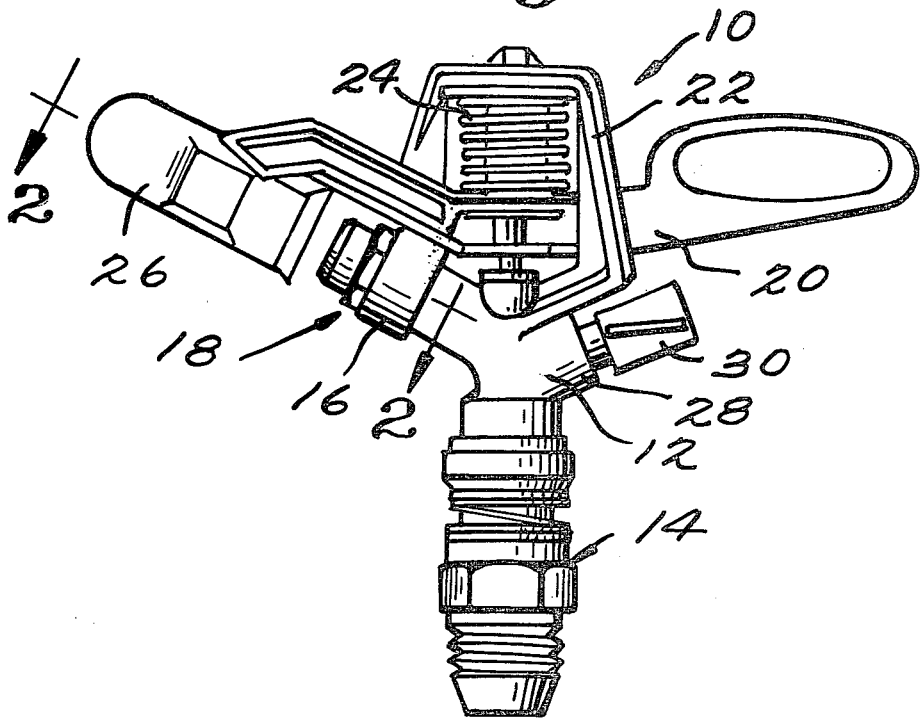
FIG. 1 is a front elevational view of a step-by-step impact sprinkler head having an improved nozzle assembly embodying the principles of the present invention.

Referring now more particularly to the drawings, there is shown in FIG. 1 thereof a step-by-step rotary sprinkler head, generally indicated at 10, embodying the principles of the present invention. The sprinkler head 10 includes the usual components comprising a hollow sprinkler body 12 having a downwardly opening inlet connected with a bearing assembly 14 of conventional construction. In accordance with conventional practice, the bearing assembly 14 is adapted to be threadedly engaged on the outlet end of a riser pipe or the like and serves to mount the sprinkler head body 12 for controlled rotational movement about an axis which extends vertically in operation. The rotation is controlled by the usual spring means embodied in the bearing assembly 14. Of course, the bearing assembly also conventionally serves to communicate a source of water under pressure with the inlet of the hollow body 12.

The water under pressure communicated with the inlet of the hollow body 12 flows upwardly and outwardly through an outlet 16 within which a nozzle assembly, generally indicated at 18, and embodying the principles of the present invention, is mounted. The sprinkler head 10 also includes an impulse arm 20 which is mounted in the usual fashion above the hollow body 12 for oscillatory movement about an axis which, in the embodiment shown, coincides with the rotational axis of the hollow body. The impulse arm 20 is mounted for oscillatory movement toward and away from a limiting position wherein the arm engages an upwardly extending generally inverted U-shaped mounting structure 22 formed integrally with the hollow body 12. In accordance with conventional procedure, the impulse arm 20 is biased into its limiting position by a coil spring 24 which is connected between the impulse arm and the mounting structure 22. Also in accordance with conventional procedure, the impulse arm 20 has an impact spoon or a reactant element 26 formed thereon in a position to be engaged by the stream of water issuing from the nozzle assembly 18 when the impulse arm is disposed in its limiting position. The reactant element includes the usual outer reactant surface which serves to effect the movement of the impulse arm in a direction away from its limiting position against the bias of the spring 24 and an inner reactant surface which pulls the reactant arm into the stream as the reactant arm approaches the limiting position under the action of the spring 24. It will be understood that the hollow body 12 may be of the type which provides a separate spreader outlet 28 within which a spreader nozzle 30 may be mounted.

In accordance with the principles of the present invention, the nozzle assembly 18 consists essentially of three components: a generally flat member, generally indicated at 32, of wear-resistant thermoset elastomeric material, preferably polyurethane having a durometer of approximately 75; a backing member, generally indicated at 34; and a body or housing member, generally indicated at 36, within which the backing member and elastomeric member 32 are mounted as a subassembly.

Figure 7:
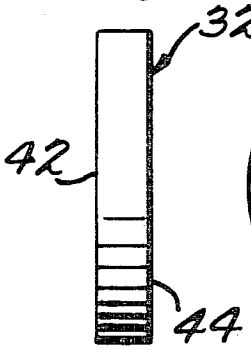
FIG. 7 is a side elevational view of the elastomeric member shown in FIG. 6.
Figure 6:
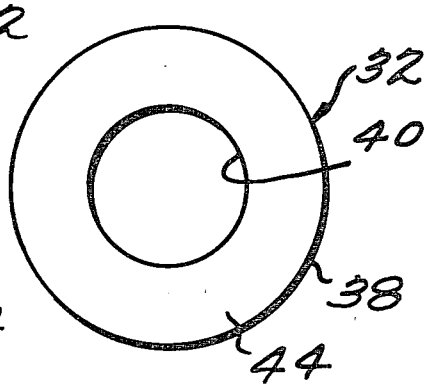
FIG. 6 is a rear elevational view of the thermoset elastomeric member of the nozzle assembly in its initial flat condition.
Figure 10:
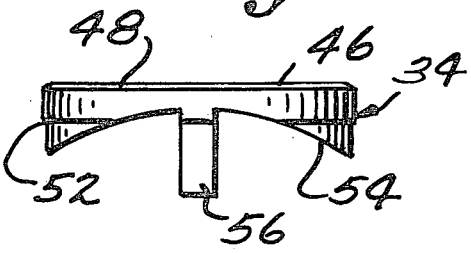
FIG. 10 is a top plan view of the backing member.
Figure 9:
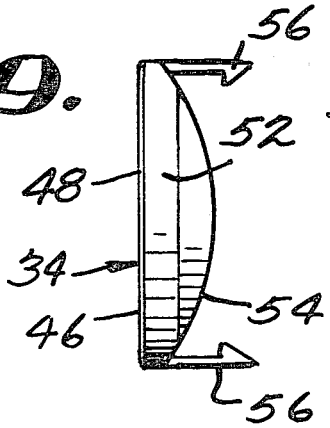
FIG. 9 is a side elevational view of the backing member.
Figure 8:
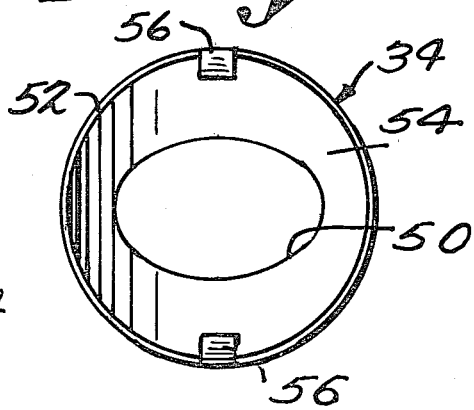
FIG. 8 is a rear elevational view similar to FIG. 6 of the backing member of the nozzle assembly.

As best shown in FIGS. 6 and 7, the thermoset elastomeric member 32 is preferably formed from a flat sheet of the thermoset elastomeric material being punched out of the flat sheet so as to have a circular exterior periphery 38 and a circular interior periphery or central aperture 40. In its initially formed condition the elastomeric member 32 includes a forward leading, or downstream flat surface 42 and a rearward trailing, or upstream flat surface 44 parallel to the flat surface 42.

The backing member 34 may be formed of any suitable material. Preferably the backing member is injection molded of an acetal resin such as Delrin ® or Celcon ®. As shown, the backing member is formed with a flat forward surface 46 defined at its outer periphery by a chamfered or short frustoconical surface 48 and at its inner periphery by an elliptical opening 50. The chamfered surface 48 leads to a stepped cylindrical peripheral surface 52. Extending between the rearward edge of the elliptical opening 50 and the rearward edge of the stepped cylindrical peripheral surface 52 is a rearward backing surface 54. Surface 54 is configured so as to be disposed within a cylinder whose axis intersects the axis of the stepped cylindrical peripheral surface 52 in rearwardly spaced relation with respect to the leading flat surface 48. It will also be noted that the cylinder within which the backing surface 54 is disposed has its axis extending in a perpendicular direction which corresponds with the direction of the minor diameter of the elliptical opening 50. Extending rearwardly from the backing surface 54 at positions adjacent the peripheral surface 52 is a pair of diametrically opposed integral hook elements 56. These elements are likewise aligned in a direction corresponding with the direction of the minor diameter of the elliptical opening 50. The hooks of the hook elements 56 are disposed in a rearwardly spaced relation from the backing surface a distance generally equal to the thickness of the elastomeric member 32. The hooks serve to aid the deformation and retain the elastomeric member 32 in a deformed condition in assembled relation with the backing member. The assembled relation is simply one in which opposed peripheral portions of the flat elastomeric member 32 are squeezed inwardly and engaged between the hook elements 56 and held thereby, the opposite peripheral portions of the elastomeric member are deformed rearwardly by engagement with the rearward curving diametrically opposed portions of the cylindrically curved backing surface 54.

The backing member 34 and elastomeric member 32 assembled therewith in the manner indicated above are then inserted within a stepped cylindrical interior surface 58 formed within an enlarged forward portion 60 of the housing member 36. The forward extremity of the forward portion 60 is then swaged over the chamfered surface 48 of the backing member 34, as indicated at 62, to retain the backing member and assembled elastomeric member 32 in fixed relation therewith. As shown, the housing member 36 includes a central peripheral portion providing six flat surfaces 64 defining a hex by which the nozzle assembly 18 is threadedly engaged within the interiorly threaded outlet 16 of the sprinkler body 12. To this end, the housing member 36 includes a rearward portion 66 which provides exterior threads 68 and a hollow interior 70 leading to the elastomeric member 32 and backing member 34 fixed within the interior peripheral surface 58 thereof.

Figure 5:
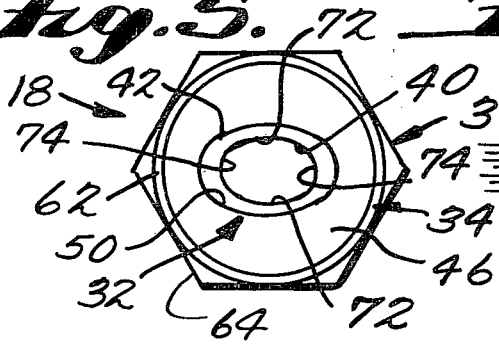
FIG. 5 is a front elevational view of the nozzle assembly.
Figure 4:
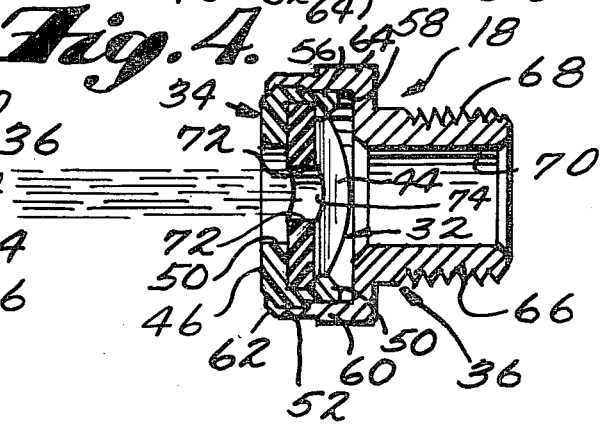
FIG. 4 is a sectional view taken along the line 4—4 of FIG. 3.

In the operation of the step-by-step sprinkler head 10, water under pressure enters the hollow sprinkler body 12 through the bearing assembly 14 and flows through the outlet 16 to the nozzle assembly 18. Water under pressure passing through the hollow interior 70 of the housing member 36 flows therethrough into communication with the rearward surface 42 of the elastomeric member 32. The swaged end 62 of the housing member fixes and seals the periphery of the backing member 34 so that the water under pressure communicating with the rearward surface 42 of the elastomeric member 32 is confined to flow outwardly through the central aperture 40 of the elastomeric member. The pressure thus serves to insure that the leading or downstream surface 42 of the elastomeric member intimately engages the cylindrically curved backing surface 54 of the backing member 34. Thus, under operating conditions, the central section of the elastomeric member defining the periphery of the aperture 50 is deformed into two diametrically opposed first portions 72 disposed in downstream axially spaced relation with respect to two diametrically opposed portions 74 displaced 90° with respect to the first portions 72. As best shown in FIG. 5, the interior aperture 40 of the elastomeric member 32 which is circular when the elastomeric member is in the initial flat condition shown in FIGS. 6 and 7 is operatively deformed into a generally oval or elliptical configuration in which the diametrically opposed portions 72 extend in the direction of and define the minor diameter of the ellipse while the portions 74 spaced upstream from the portions 72 extend in the direction of and define the major diameter of the ellipse.

Figure 2:
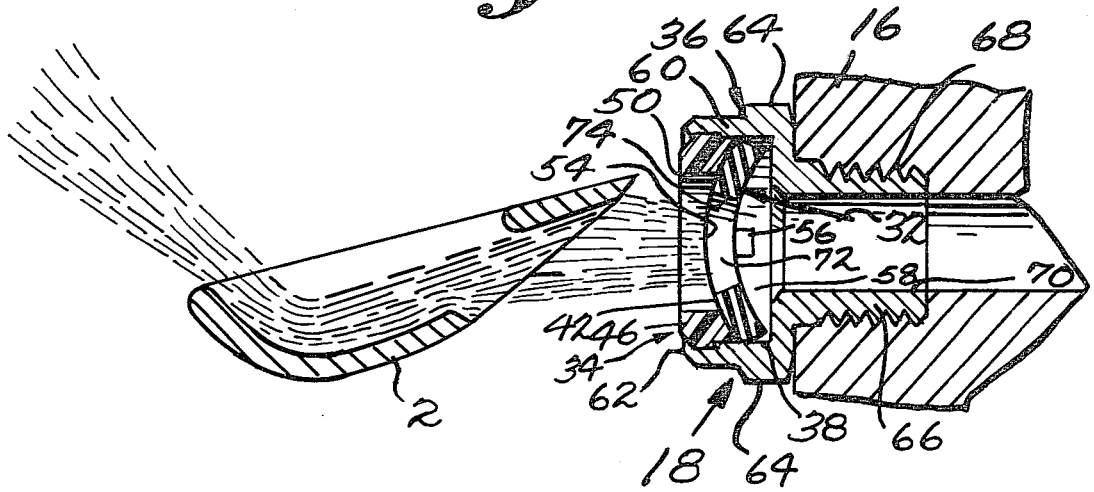
FIG. 2 is an enlarged fragmentary sectional view taken along the line 2—2 of FIG. 1.
Figure 3:
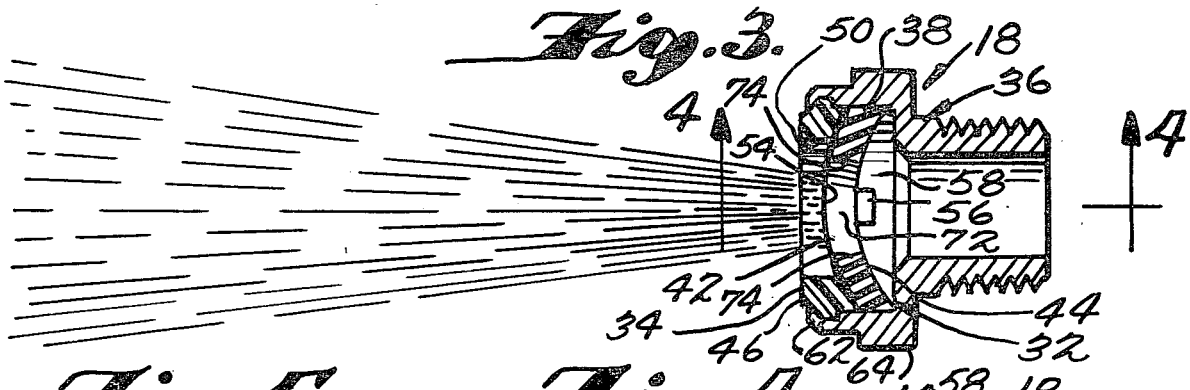
FIG. 3 is a sectional view of the nozzle assembly, similar to FIG. 2, showing the outwardly fanned configuration of the discharge stream when the impact spoon is out of the path thereof.

It can be seen that since the first portions 72 are disposed in downstream spaced relation with respect to the second portions 74, the pressure of the water or the integrity of the flow of the water through the nozzle assembly 18 downstream to the position of engagement with the portions 72 is maintained, whereas the pressure of the water or integrity of the flow to the point of the upstream portions 74 is reduced or alleviated prior to reaching the downstream portions 72. Thus, as the stream issues from the deformed aperture 40 of the elastomeric member it is defined by the periphery of the aperture including diametrically opposed portions 72 and 74 into a stream which tends to remain flattened in the diametrical direction defined by the first portions 72 and to fan out due to reduced pressure in the diametrical direction of the upstream portions 74. The fanned out condition of the spray is illustrated in FIG. 3. FIG. 2 illustrates the extreme position of the reactant element 26 of the impulse arm 20 within the stream and it will be noted that substantially the entire fanned out spray is received by the reactant element and deflected so as to obtain maximum energy from the stream to effect oscillation thereof even though the sprinkler head is operated at a relatively low pressure. In this regard, it will be noted that the fanning out of the spray in a horizontal direction enables the sprinkler head to operate effectively at lower operating pressures with the stream which issues from the nozzle assembly 18, when unbroken by the spoon, spread out or fanned out in a flat configuration containing droplets of a desirable size which are less then the droplet size which would occur with a cylindrically shaped conventional outlet of comparable capacity.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A nozzle assembly for a water sprinkler comprising a generally flat member of wear resistant thermoset elastomeric material having an aperture in the central portion thereof constituting the stream defining orifice of the nozzle and means for mounting said elastomeric member in a sprinkler in flow transmitting relation to a source of water under pressure communicated therewith including a rigid backing member having a central opening through which the stream defined by the nozzle orifice passes, said backing member having surface means surrounding said opening and facing in a direction opposed to the direction of stream movement operable to engage and support said elastomeric member in a deformed operative condition in which first portions of said flat member defining diametrically opposed portions of the periphery of the aperture thereof are disposed in downstream spaced relation with respect to second portions thereof defining diametrically opposed portions of the periphery of the aperture thereof displaced 90° from said first portions so that the stream as it issues from the aperture of the flat member in said deformed condition tends to remain flattened in the direction of spacing of said first portions and to fan out in a desirable droplet size in the direction of spacing of said second portions.

2. In an impact sprinkler comprising a sprinkler body, means for connecting said sprinkler body to a source pipe in communicating relation to a source of water under pressure contained therein for controlled step-by-step rotational movement about a vertical axis, said sprinkler body having at least one outlet, a nozzle assembly in said outlet for directing water under pressure communicating with said sprinkler body in a stream extending radially outwardly and upwardly with respect to said vertical axis, an impact arm mounted on said sprinkler body for oscillatory movement to effect the step-by-step rotational movement of said body and a spoon on said arm for engaging the stream issuing from said nozzle assembly to effect the oscillatory movement of said impact arm, the improvement which comprises said nozzle assembly comprising a generally flat member of wear resistant thermoset elastomeric material having an aperture in the central portion thereof constituting the stream defining orifice of the nozzle and means for mounting said elastomeric member in the outlet of said sprinkler body including a rigid backing member having a central opening through which the stream defined by the nozzle orifice passes, said backing member having surface means surrounding said opening and facing in a direction opposed to the direction of stream movement operable to engage and support said elastomeric member in a deformed operative condition in which first portions of said flat member defining vertically diametrically opposed portions of the periphery of the aperture thereof are disposed in downstream spaced relation with respect to second portions thereof defining horizontally diametrically opposed portions of the periphery of the aperture thereof displaced 90° from said first portions so that the stream as it issues from the aperture of the flat member in said deformed condition tends to remain flattened in the vertical direction of said first portions and to fan out in a desirable droplet size in the horizontal direction of said second portions.

3. A nozzle assembly as defined in claim 1 or 2 wherein said first portions are also deformed in a direction toward one another when said elastomeric member is disposed in said deformed condition.

4. A nozzle assembly as defined in claim 3 wherein said elastomeric member is circular and said aperture is circular when said elastomeric member is flat.

5. A nozzle assembly as defined in claim 4 wherein said backing member is circular and includes opposed hook portions extending in an upstream direction for engaging opposed peripheral portions of said elastomeric member corresponding with the first aperture defining portions thereof.

6. A nozzle assembly as defined in claim 4 wherein said backing member surface means is contained within a cylinder having an axis perpendicularly intersecting the axis of said elastomeric member at a position spaced upstream therefrom, said cylinder axis extending in a direction corresponding to the direction of said first portions.

7. A nozzle assembly as defined in claim 6 wherein said elastomeric material is polyurethane.

8. A nozzle assembly as defined in claim 7 wherein said elastomeric material has a durometer of approximately 75.

9. A nozzle assembly as defined in claim 3 wherein said elastomeric material is polyurethane.

10. A nozzle assembly as defined in claim 9 wherein said elastomeric material has a durometer of approximately 75.

11. A nozzle assembly as defined in claim 1 or 2 wherein said elastomeric material is polyurethane.

12. A nozzle assembly as defined in claim 11 wherein said elastomeric material has a durometer of approximately 75.

* * * * *